United States Patent [19]

Kristensson

[11] 4,157,593

[45] Jun. 12, 1979

[54] PATIENT LIFT AND TRANSPORT APPARATUS

[75] Inventor: Nils L. O. Kristensson, Stockholm, Sweden

[73] Assignee: Landstingens inkopscentral LIC, Ekonomisk forening, Solna, Sweden

[21] Appl. No.: 846,345

[22] Filed: Oct. 28, 1977

[30] Foreign Application Priority Data

Nov. 1, 1976 [SE] Sweden ..... 7612118

[51] Int. Cl.[2] ..... A61G 7/08

[52] U.S. Cl. ..... 5/81 R; 5/86; 5/89

[58] Field of Search ..... 5/81 R, 86, 89, 92, 5/317 R; 182/122

[56] References Cited

U.S. PATENT DOCUMENTS

| | | | |
|---|---|---|---|
| 1,735,003 | 11/1929 | Heidel | 182/122 |
| 3,458,878 | 8/1969 | Combs | 5/81 R |
| 3,623,169 | 11/1971 | James | 5/81 R |
| 3,694,829 | 10/1972 | Bakker | 5/81 R |
| 3,940,808 | 3/1976 | Petrini | 5/81 R |

*Primary Examiner*—Casmir A. Nunberg

*Attorney, Agent, or Firm*—Cushman, Darby & Cushman

[57] ABSTRACT

A patient lift and transport apparatus with means for lifting a patient from a sitting position on a chair or bed to a transporting position in the apparatus. The apparatus is provided with retaining means for holding the patient in a sitting position during transportation, with the knees resting against a knee support and the seat of the patient resting against a lifting belt extending obliquely upwards over the region of the neck of the patient's femurs, said lifting belt being removably secured to two fastenings on the apparatus.

14 Claims, 9 Drawing Figures

Figure 1:
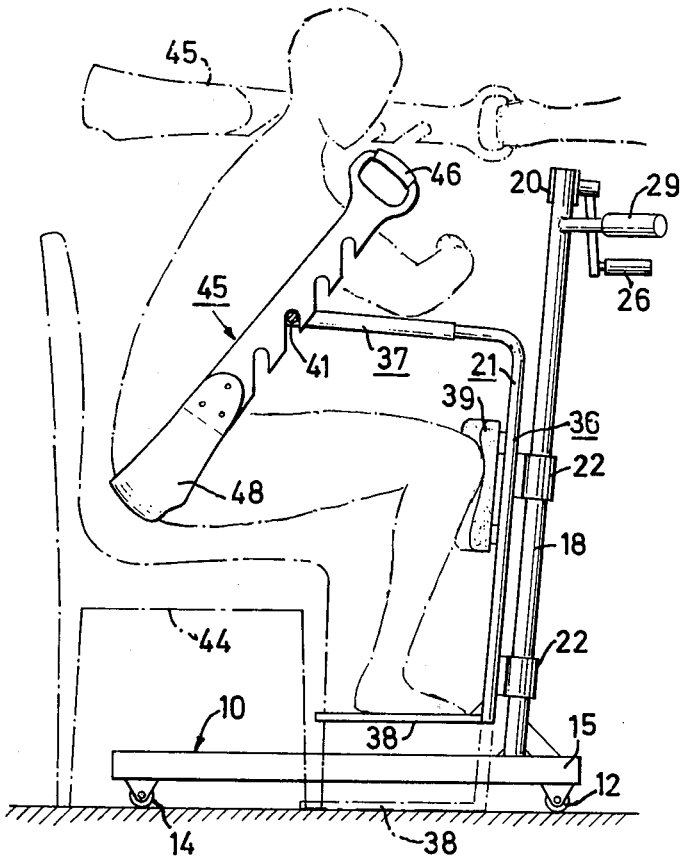

FIG. 4
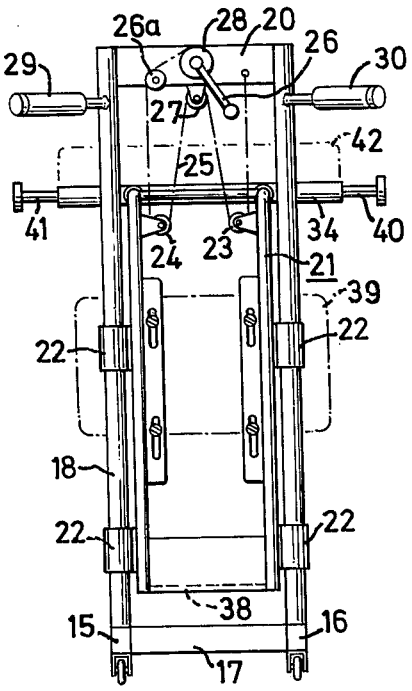
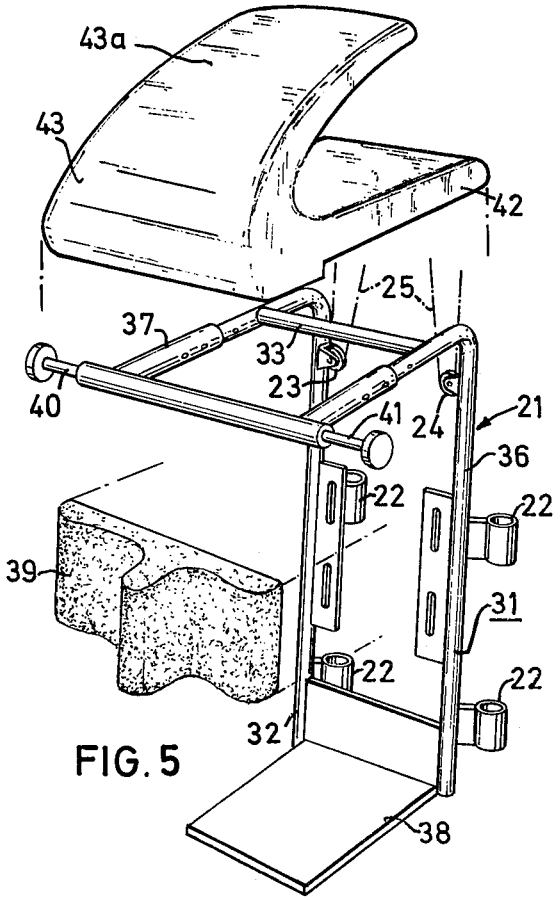
FIG. 5

PATIENT LIFT AND TRANSPORT APPARATUS

The present invention relates to a patient lift and transport apparatus with carrier wheels and means for lifting a patient from a sitting position in a chair or on a bed to a transporting position on the apparatus and vice versa, the apparatus being provided with retaining means for retaining the patient in the transporting position on the apparatus.

With disabled persons such as certain patients and invalids in hospitals, there are often substantial difficulties for the patient as well as the nurse or other staff member in moving a sitting patient from a wheelchair, for example, to a WC seat or to a bed. If the patient is of normal weight or heavier, two persons are needed for lifting in most cases. Different mechanical aids have been proposed so that a single nurse can carry out this work. The mechanical aids known to the art are however very far from being satisfactory, since the patient must be handled in a way which is often felt as being very unpleasant for the patient. The means for lifting invalids disclosed in the U.S. Pat. No. 3,277,502 is referred to as an example of known mechanical aids. In this known apparatus the patient is lifted under the arms at the armpits with the help of a pair of stirrups raised by means of pivotable lifting arms, the patient then being transported suspended in a semi-standing attitude. After suspending the patient one can then fasten a belt under the seat of the patient, as a safety measure in case the patient should glide out of the stirrups. Apart from the patient feeling a psychological revulsion against being transported in such an unnatural position, there is also the drawback that a large portion of the patient's weight is taken up by parts of the body not normally used for taking the weight of the patient in a sitting or a lying position.

The object of the present invention is therefore to provide a patient lift and transport apparatus so constructed that the patient can be lifted gently from a sitting position on a chair, for example, while retaining a substantially normal sitting attitude and with the greater part of the lifting force being applied at a place to which the patient is accustomed, i.e. his seat, it being possible to keep the patient's sitting attitude and the lifting and compression forces acting on the patient substantially unaltered, from the moment the patient releases contact with the chair during lifting, until the patient is in the transporting position, during actual transport and during setting the patient down in a sitting attitude on another chair or the like.

This is enabled by a patient lift and transport apparatus which according to the invention has the characterizing features set forth in the accompanying claims.

To lift a patient from a chair, the apparatus according to the invention is moved up to the sitting patient. The sitting patient's legs are placed so that the knees come against a knee support on the apparatus. The upper part of the patient's body is inclined somewhat forwardly, preferably against a chest support. The patient's arms are preferably laid on an armrest in a restful position in front of the patient. The chest support preferably extends upward above the armrest so that the patient can hold his forearms around the chest support, which gives the patient an increased sense of sitting securely. The feet preferably rest on a foot support. As a final operation, which is extremely easy for the nurse to do quickly and surely without it involving any unpleasantness for the patient, the nurse takes an elastically flexible lifting belt by its ends and forms it to a U-shape, moving it down behind the patient's back and to his seat where the central portion of the belt bent into a loop is introduced into the wedge-shaped free space between the patient's seat and the seat of the chair. The belt is then drawn up against the patient's seat, positioned inclined upwards at the sides and secured to fastenings intended for the lifting belt. The inclination of the belt to the horizontal plane is suitably in the region of about 45°.

The patient is now in a comfortable starting position for lifting, which takes place by the fastenings being raised together with the knee support. If the apparatus is provided with chest support, armsrest and foot support, all these parts, together with the fastenings, are carried by a unit which is raisable and lowerable by means of mutually operated power means to a desired height in relation to the frame carrying the supporting wheels of the apparatus. The power means can be of any known kind. For a simple embodiment, a winch with lifting wires or belts can be used, having a crank for raising and lowering the unit. If it is desired to use more costly apparatuses, there are known types of mechanical jacks or hydraulic lifting means available. The main thing is that the power means only requires a relatively small hand force for its operation, and that it provides a smooth and well-controlled movement upwards and downwards to the desired height for the unit and the respective parts carried by it. Whatever lifting mechanism is used, it must automatically stop when the force operating the lifting mechanism is removed.

When the lifting belt is well stretched against the seat of the patient and secured to the fastenings, it comes against the patient's seat with a certain pressure before lifting starts. When lifting starts, the patient will practically only notice an increasing pressure against his seat. The patient's body and its parts maintain substantially the same attitude the whole time. When the patient releases contact with the chair, the patient is in the transporting position and the apparatus can now be rolled away from the chair and to a desired location. During transport, the patient sits comfortably and securely. Setting the patient down on a bed or another chair takes place by the unit being lowered carefully until the patient rests with his bottom against the bed or chair seat, and the lifting belt is thus unloaded. The latter can then be released simply and quickly from the fastenings and is thereafter swung up above the patient to allow subsequent removal of the apparatus.

A suitable embodiment of the patient lift and transport apparatus according to the invention is shown schematically as an example on the attached drawings.

Figure 2:
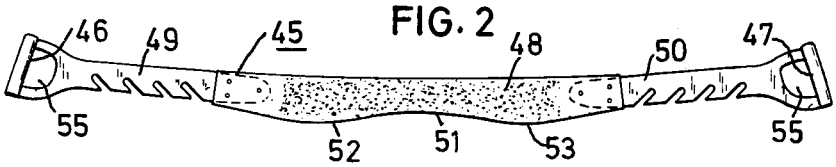
Figure 3:
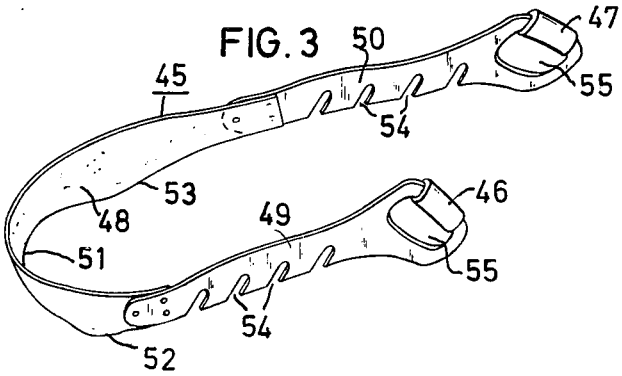
Figure 8:
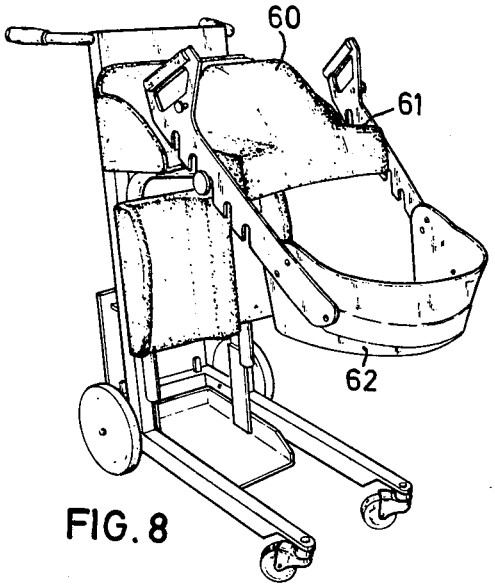
Figure 9:
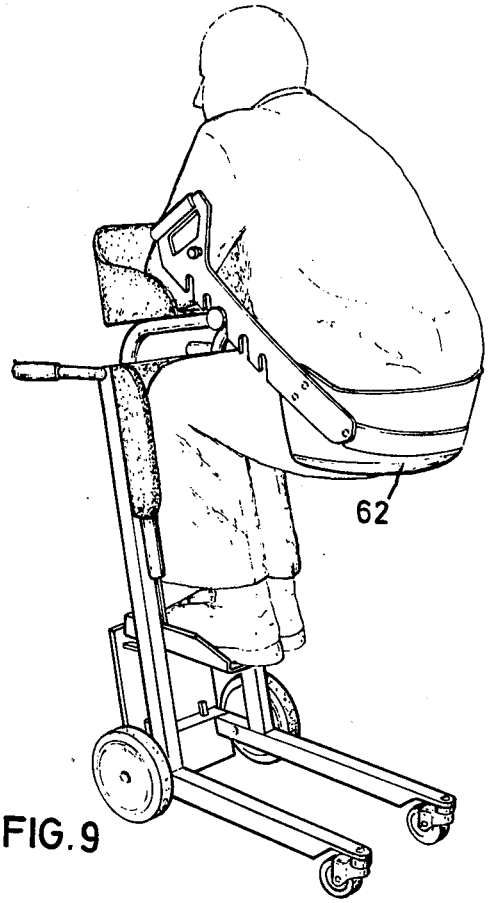
Figure 7:
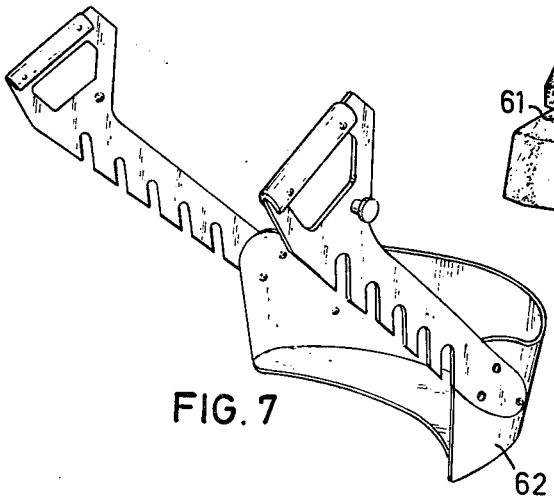
Figure 6:
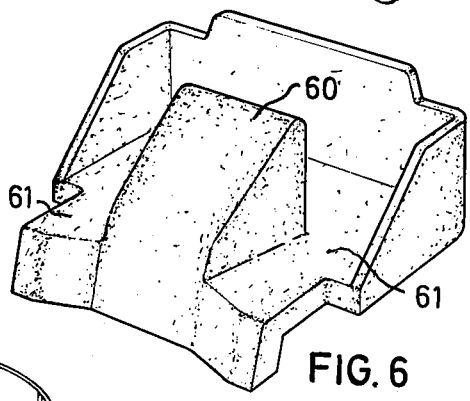

FIG. 1 is a side view of the apparatus according to the invention, carrying a sitting patient in a raised transporting position, FIG. 2 shows the lifting belt in its entire length, FIG. 3 shows the lifting belt bent to a U-shape, FIG. 4 is a view of the apparatus seen from the front, FIG. 5 is a schematic, partially exploded perspective view of the raisable and lowerable unit carrying the foot support, knee support, chest support, armrest and fastenings for the lifting belt, the knee support and the chest support with its armrest being shown in separated positions for the sake of clarity, FIG. 6 is a perspective view of another embodiment of the chest support and armrest, FIG. 7 is a perspective view of another embodiment of the lifting belt, FIG. 8 is a perspective view of a somewhat modified apparatus provided with the chest support in FIG. 6 and the lifting belt in FIG. 7, and FIG. 9 is the same view as in FIG. 8 with the unit in raised position.

The apparatus has a frame 10 carried by a pair of forward wheels 12 and a pair of rear wheels 14. The frame is U-shaped with side limbs 15,16 and a cross strut 17.

At the forward ends of the side limbs there are attached a pair of substantially vertical posts 18,19, joined together at their upper ends by a crosspiece 20.

A unit 21 (FIG. 5) is mounted on the posts and has means guided along the posts for raising and lowering the unit. In the example shown, the guiding means consist of gliding sleeves 22, but the guiding means can also consist to advantage of wheels running along guideways in the posts.

At its upper end the unit has a pair of idler pulleys 23,24 for a lifting wire 25 or a lifting belt, also running over idler pulleys 26 and 27, which are rotatably mounted in holders attached to the crosspiece 20.

By means of the idler pulleys there is obtained the desired reduction for reducing the force on a crank **26*a* driving a schematically shown winch 28 carried by the crosspiece. The winch 28 can to advantage be of the known type which is used for lifting sacks and other objects and which automatically brakes the load to a standstill as soon as the crank 26*a*** is not actuated.

Raising and lowering the unit 21 can, however, take place in any other suitable mode, e.g. by means of conventional hydraulic lifting apparatuses or a mechanical jack.

The posts 18,19 are provided with forwardly directed handles 29,30 at their upper ends, for guiding the apparatus when it is to be rolled along the floor.

The unit shown in FIG. 5 consists of a frame having two side tubes 31,32 joined by crosspieces 33,34,35 and bent at an angle to form a substantially vertical portion 36 and a substantially horizontal portion 37, which may have an adjustable length.

At its lower end the vertical portion 36 has a substantially horizontal foot supporting plate 38, which can be provided with side walls (not shown) for securely retaining the patient's feet on the plate.

A knee support 39 is attached to the vertical portion 36 and is provided with a cushion of elastic material so that the patient's knees can be kept comfortably against it. The knee support is suitably adjustable in height as is indicated schematically in FIGS. 4 and 5.

The horizontal portion 37 is provided with pins 40,41 projecting sideways at its outer end, these pins forming the fastenings for the lifting belt shown in FIGS. 2 and 3 in the manner illustrated in FIG. 1.

On the horizontal portion there is further attached a flat armrest 42 with an upper side formed from an elastic material.

The armrest 42 merges into a chest support 43 at its outer end, the chest support extending slopingly upwards above the armrest 42 and at a free height above it. In this way the patient can lean against the chest support and place the forearms about the upwardly projecting end portion of the chest support, thus obtaining a comfortable and safe grip which prevents falling backwards during raising and transport.

A chair 44 is shown with chain-dotted lines in FIG. 1. The patient, shown with chain-dotted lines, is in a raised transporting position, but is assumed to be sitting on a chair.

The apparatus is then rolled forward to the position shown in FIG. 1, with the unit 21 lowered to its bottom position where the foot supporting plate 38 will be in its chain-dotted position close to the floor. In some cases the foot support can be pushed under the patient's feet, but usually it is necessary to help the patient by putting his feet on the foot support. The apparatus is rolled far enough in towards the patient so that his knees are against the rest 39. The patient's arms are laid on the armrest 42 and the upper part of the patient's body is inclined forwardly to the shown position, where the patient's chest engages against the chest support 43.

The lifting belt 45 shown in FIG. 2 is suitably hung on one of the handles 29,30. When the patient is in the initial sitting position described above, the lifting belt 45 is taken off the handle of the apparatus and gripped with each hand in the handles 46,47 at its ends and is bent into a U-shape as in the embodiment shown in FIG. 3, for example.

The U-shaped lifting belt is swung down over the patient and thereby passes through the horizontal position shown with chain-dotted lines in FIG. 1. The bottom portion 48 of the U-shaped belt is taken down behind the patient to the patient's seat and into the wedge-shaped space between the patient's seat and that of the chair. The lifting belt is pulled slopingly upwards until the belt is stretched along the sides and it is then secured to the pins 40,41. In this position the patient can now be lifted from the chair by raising the unit 21 by means of the crank **26*a***.

When the patient is lifted from the chair, there is first a slight bending at the knees before the lifting belt lies firmly against the patient's seat. When the belt takes up the weight of the patient, there is simultaneously obtained a force component pressing the patient's knees into firm engagement with the knee support.

As is apparent from FIGS. 4 and 5, the pins are located at the sides of the chest support 43, and in such a position according to FIG. 1 that the lifting belt will form an angle with the horizontal plane in the region of about 45° when the belt is stretched about the patient's seat.

In order to use the lifting belt easily in the mode described above, it suitably consists of two relatively stiff limbs 49,50 which are firmly attached to the more easily flexed middle portion 48. The limbs 49,50 can consist of metal or stiff plastic, while the middle portion 48 is suitably a flexible plastic which may be provided with a friction-increasing coating on the inside of the belt.

To facilitate application against the patient's seat, when the patient is sitting on the chair, the middle portion is narrower at its centre 51, and merges into wider side portions 52,53 intended to engage against the sides of the patient's seat.

One edge of each limb is provided with a plurality of notches 54 directed at an angle away from the handles of the lifting belt, these notches being adapted for securing to the pins 40,41.

At their ends the limbs are made with relatively roomy handle openings 55 so that the handles can be easily hung up on the handles 29,30 when the lifting belt is not used.

In most cases the patient is satisfactorily retained in the transporting position according to FIG. 1. If a chest support 43 of the kind shown in FIG. 5 is also used, so that the patient can hold his arms about the chest support and under its free extended portion 43a, the patient's feeling of safety is naturally increased considerably. Should further retention be required, however, it is easy to arrange further retaining belts or bands extending about the patient's legs or about the patient's back, the belts being attached either to the horizontal portion 37 of the unit 21, e.g. on the pins 40,41, or to the lifting belt 45. These further retaining belts can then be easily applied after the patient has been raised into the transporting position.

In FIG. 6 there is shown another embodiment of the chest support 60 which projects upwardly from the surfaces 61 forming the armrest. The forearms of the patient are intended to be laid about the chest support 60.

In FIG. 7 there is shown a lifting belt having a middle portion in the form of a basket 62 which will form a somewhat safer support for the patient's seat than the middle portion 51 of the lifting belt shown in FIG. 3.

What I claim is:

1. A mobile patient lift and transport apparatus for lifting a patient from a sitting and leaning-forward position on a chair or bed and suspending the patient during transport, said apparatus comprising a frame having at least three floor-engaging wheels and a raisable and lowerable unit, power means carried by said frame for adjustably raising and lowering said unit, a knee support carried by said unit in a position to engage the knees of a patient when in a sitting position, retaining means for holding a patient in a sitting and leaning-forward position with his knees pressed against said knee support, said retaining means including a U-shaped belt having a handle at each end and extending obliquely at an angle of 30° to 60° to the horizontal and upwardly and forwardly with respect to the patient so that the center portion of the belt is capable of passing over the neck of the patient's femurs, and means on said unit for removably attaching the belt at locations near its ends to said unit whereby a patient can be raised and lowered by raising and lowering said unit.

2. Apparatus as in claim 1 including a chest support carried by said raisable and lowerable unit, said chest support being located forwardly of the center portion of said belt so as to be engaged by the patient's chest when in a leaning-forward position.

3. Apparatus as in claim 2 wherein the number of wheels is four and wherein said wheels are arranged as forward and rear pairs, with the rear pair being positioned generally under the center portion of said belt and the rear pair being positioned generally under said chest support.

4. Apparatus as in claim 1 wherein said belt includes, at least at its middle portion, an elastically flexible material so that said belt can be bent into a U-shape and then be held at its ends in a substantially horizontal position while retaining its U-shape.

5. Apparatus as in claim 4 wherein the belt bent into a U-shape has two limbs and a middle portion, the limbs being more rigid than the middle portion so that, when the middle portion is bent into a loop, the limbs will form substantially straight and generally unbent limbs.

6. Apparatus as in claim 4 wherein said means for removably attaching said belt to said raisable and lowerable unit includes two pins or the like located on either side of said unit, said lifting belt being formed along one edge, the lower edge in the patient-carrying position, with a plurality of notches fitting the pins for removable attachment of the belt to the pins after taking the belt around the patient's seat.

7. Apparatus as in claim 1 wherein said wheels are four in number and arranged as a forward pair and a rear pair, said frame including at least one substantially vertical post in the vicinity of the forward wheel pair, guide means cooperating with said post and with said unit for guiding said unit in a substantially vertical path relative to said post, said unit having a substantially vertical portion situated parallel to the post and carrying said knee support, said unit also having a substantially horizontal portion extending out from the vertical portion above the area between the forward and rear wheel pairs, said horizontal portion carrying an armrest and a chest support as well as said means for removably attaching said belt to said unit.

8. Apparatus as in claim 7 including a handle at the upper end of said post for maneuvering the apparatus on the floor.

9. Apparatus as in claim 7 wherein said armrest is planar and wherein said chest support extends up over said armrest, so that the forearms of the patient can be laid up on the armrest on the opposite side of the chest support in relation to the patient's chest, the patient being able to hold around the chest support as security against falling backwards.

10. Apparatus as in claim 1 wherein the middle portion of said belt includes a basket adapted to receive the seat of the patient.

11. A mobile patient lift and transport apparatus for lifting a patient from a sitting position on a chair or bed and suspending the patient during transport, said apparatus comprising: a frame having forward and rear pairs of floor-engaging wheels and at least one substantially vertical post in the vicinity of the forward wheel pair, a raisable and lowerable unit; a belt extending obliquely upwardly and forwardly so as to be capable of passing over the region of the neck of the patient's femurs; guide means cooperating with said post and with said unit for guiding said unit in a substantially vertical path relative to said post, said unit having a substantially vertical portion situated parallel to said post and carrying a knee support adapted to be engaged by the knees of a patient in a sitting position, said unit also having a substantially horizontal portion extending out from the vertical portion above the area between the forward and rear wheel pairs; said horizontal portion carrying an armrest for the patient's arms, and carrying a chest support for the patient's chest and carrying means for removably attaching said belt at locations near its ends to said horizontal portion.

12. Apparatus as in claim 11 wherein said armrest is planar and wherein chest support extends up over said armrest, so that the forearms of the patient can be laid up on the armrest on the opposite side of the chest support in relation to the patient's chest, the patient being able to hold around the chest support as security against falling backwards.

13. Apparatus as in claim 11 wherein said belt is inclined at an angle of 30° to 60° to the horizontal.

14. A mobile patient lift and transport apparatus for lifting a patient from a sitting position on a chair or bed and suspending the patient during transport comprising: a frame having a lower horizontal portion carrying floor engaging wheels, said horizontal portion being insertable under a chair or bed so as to bring said apparatus close to the patient; a raisable and lowerable unit carried by said frame; a patient knee support carried by said unit; a horizontal patient foot rest carried by said unit at a location directly below said knee support; a patient chest support carried by said unit at a location above and rearwardly of said knee support for engagement by the patient's chest when the patient is in a leaning-forward position; and a U-shaped patient-supporting belt removably attached near its ends to said unit, said belt lying in an inclined plane which extends upwardly and forwardly and through said chest support, the center portion of said belt being located rearwardly of said foot rest and being adapted to pass under the seat of the patient.

* * * * *